United States Patent [19]

Sulasaari et al.

[11] 4,411,146

[45] Oct. 25, 1983

[54] METHOD AND APPARATUS FOR THE STRAIGHTENING AND STIFFENING OF STARTING SHEETS IN ELECTROLYTIC REFINING PLANTS

[75] Inventors: Jukka Sulasaari, Tampere; Seppo Heinonen, Rauma, both of Finland

[73] Assignee: Outokumpu Oy, Helsinki, Finland

[21] Appl. No.: 254,412

[22] Filed: Apr. 15, 1981

[30] Foreign Application Priority Data

Apr. 15, 1980 [FI] Finland ..... 801203

[51] Int. Cl.[3] ..... B21D 1/10

[52] U.S. Cl. ..... 72/180; 72/181; 72/379; 204/281

[58] Field of Search ..... 204/281; 72/176, 177, 72/180, 181, 379

[56] References Cited

U.S. PATENT DOCUMENTS

| | | | |
|---|---|---|---|
| 815,710 | 3/1906 | Johnson | 72/180 |
| 1,836,368 | 12/1931 | Eppensteiner et al. | 204/281 |
| 1,900,722 | 3/1933 | Manske et al. | 72/181 |
| 3,117,036 | 1/1964 | Cleland et al. | 72/181 |
| 3,544,431 | 12/1970 | Spoon | 204/281 |
| 3,690,137 | 9/1972 | Cookson | 72/180 |

*Primary Examiner*—Lowell A. Larson

*Attorney, Agent, or Firm*—Brooks Haidt Haffner & Delahunty

[57] ABSTRACT

Starting sheets are straightened and stiffened in electrolytic refining plants by shaping the same predetermined areas of the starting sheet surfaces once or several times during successive shaping stages in such a manner that the elasticity range of the starting sheet material is at least in part exceeded. During each shaping stage depressions or grooves deviating from the plane of the starting sheet surface are produced in the starting sheets by shaping the said same areas of the starting sheet surface alternately from the opposite sides of the starting sheet during the different shaping stages, whereby the alternate shaping of the areas of the starting sheet surfaces from the opposite sides of the starting sheet straightens the starting sheet and causes work-hardening in the material of the starting sheet, and the depressions or grooves deviating from the plane of the starting sheet surface cause a stiffening of the starting sheet.

11 Claims, 4 Drawing Figures

METHOD AND APPARATUS FOR THE STRAIGHTENING AND STIFFENING OF STARTING SHEETS IN ELECTROLYTIC REFINING PLANTS

BACKGROUND OF THE INVENTION

The present invention relates to a method for straightening and stiffening starting sheets in electrolytic refining plants.

The invention also relates to an apparatus for carrying out the method according to the invention.

In the electrolytic refining of a metal, e.g. copper, the starting sheets detached from the base plate are attached to supporting bars and the starting sheets are then lowered into the electrolytic tanks, in which the starting sheets are allowed to grow into cathode plates.

In connection with their being detached from the base plate, the starting sheets often bend or even wrinkle. While being lowered into the electrolytic tanks or during other handling the starting sheets may be warped or their shape may otherwise change.

If the shape of the starting sheets deviates from a flat shape, the distances of the different points of the starting sheets from the anodes in the electrolytic tanks are not equal, and consequently those points of the starting sheets which are closest to the anodes grow fastest until they produce a short circuit.

In refining plants it has usually been necessary to move and adjust the starting sheets manually after they have been lowered into the electrolytic tanks, and in order to eliminate short circuits produced during the process it has been necessary to detach the starting sheets from the anodes by means of various auxiliary devices and to lift starting sheets from the electrolytic tanks and to straighten them by means of hand tools.

In order to reduce the above-described work stages, which require a great deal of manual labor and slow down the total process, and in order to improve the quality of the cathodes, the objective has been to straighten and stiffen the starting sheets to make them as flat as possible.

Starting sheets detached from the base plate have previously been straightened by means of rollers intended for the straightening of thin sheets and also by means of straightening devices specifically designed for the straightening of starting sheets. By means of several known devices, the unevenness of starting sheets can be substantially reduced and the shape obtained for the starting sheets is rather flat, but the stiffness of the starting sheets is not, however, sufficient. In order to prevent the starting sheets from changing their shape and in order to stiffen the starting sheets, fold and groove patterns have been made in them. The grooves or other protrusions deviating from the plane of the starting sheet surface must not be too deep or sharp-crested, since the anode slime and other impurities present in the electrolyte easily accumulate on the surface of starting sheets.

As regards the present state of the art, reference is made to U.S. Pat. No. 1,836,368, which discloses one example of the stiffening of starting sheets by means of a press and certain tools. By the method according to the invention, stiffening grooves covering nearly the entire surface of the starting sheets are obtained. However, stiffening of starting sheets by means of pressing has several disadvantages. Firstly, owing to the unevenness of the starting sheet surfaces and to the elasticity of the material, several starting sheets are considerably warped during the stiffening. Secondly, the tools required for the stiffening are quite expensive. Thirdly, the stiffness obtained is often insufficient, and starting sheets still become distorted during handling.

Starting sheets have also been stiffened by the rolling of grooves or other stiffening patterns into them, but the problems are similar to those encountered in stiffening by means of a press. Owing to variation in the starting sheet thickness and to variation in their crystal structure, it is not possible to control the rolling procedure, and the starting sheets are warped during the rolling and, furthermore, the stiffness produced is usually insufficient.

As regards the present state of the art, reference is made to U.S. Pat. No. 3,544,431. In the method according to this patent, the starting sheets detached from the base plate are straightened and stiffened by rolling, whereafter the starting sheets are allowed to grow in the electrolytic tanks to about double their thickness. Thereafter the starting sheets are lifted out of the electrolytic tanks and transferred to a press, by which the starting sheets are re-straightened and re-stiffened. Thereafter, the starting sheets are returned to the electrolytic tanks to grow into the final cathodes. This prior known method includes a very complicated, operationally vulnerable and expensive press unit. In addition, lifting the starting sheets out of the electrolytic tanks in between and transferring the starting sheets to the press and then back into the electrolytic tanks require exceptional arrangements in the refining plants, regarding the use of space, for example. The lifting capacity is also taken to its limit in lifting the starting sheets back and forth. It is not possible to treat an entire electrolytic tank full of starting sheets, but depending on the size of the electrolytic tank the starting sheets can be treated in two or several batches. Furthermore, the acquisition costs of the equipment required for this known method are high.

The object of the present invention is to provide an improvement to prior known methods for the straightened and stiffening of starting sheets used in electrolytic refining plants. The object of the invention is to provide a method which makes it possible to obtain sufficiently flat and stiff starting sheets, whereby the number of short circuits produced between the starting sheets and the anodes in the electrolytic tanks can be reduced substantially. A more specific object of the invention is to provide a straightening and stiffening method for starting sheets, a method in which variations in the starting sheet thickness, in the evenness of the surfaces and in the properties of the material do not cause warping of the starting sheets or any other undesirable phenomena. The other objectives of the invention and the advantages gained using it are disclosed in the description of the invention.

SUMMARY OF THE INVENTION

The objects of the invention are achieved by a method in which predetermined areas of the starting sheet surfaces are shaped once or several times in successive shaping stages in such a manner that the elasticity range of the starting sheet material is at least in part exceeded, and that, in each shaping stage, depressions or grooves, or other patterns deviating from the plane of the starting sheet surface, are produced in the starting sheets in such a manner that during the different shaping stages the said same areas of the starting sheet surfaces or at least some of the said areas, are shaped alternately from opposite sides of the starting sheet, in which case the alternate shaping of the said areas of the starting sheet surfaces from the opposite sides of the starting sheet straightens the starting sheet and causes work-hardening in the material of the starting sheet, and the depressions or grooves or other patterns deviating from the plane of the starting sheet surface stiffen the starting sheet.

The invention also provides an apparatus for carrying out the method according to the invention. The apparatus according to the invention comprises (a) a frame;

(b) at least two pairs of rollers at a distance from each other, attached with bearings to the frame of the apparatus and consisting of two rollers one on top of the other, the surface of the said rollers or the mantle or sleeves on the surface of the said rollers being provided with the desired profile or pattern, which is formed on the starting sheets, (c) separate bearing components by mediation of which the said rollers are attached to the said frame part, and (d) a drive device for producing the rotational motion of the said rollers.

Significant advantages are gained using the method and apparatus according to the invention. In the method according to the invention, sufficient flatness and stiffness is produced in the starting sheets, and consequently the number of short circuits between the starting sheets and the anodes in the electrolytic tanks is substantially reduced. Thus the efficiency of the process can be improved and at the same time the need for adjustment of starting sheets in the electrolytic tanks and for detaching of the starting sheets from the anodes is reduced, as is the need for straightening the starting sheets by means of hand tools. In the method according to the invention the starting sheet can be straightened and stiffened simultaneously. Compared with prior known methods, variations in the thickness of the starting sheets, in the evenness of their surfaces and in the properties of the material have substantially less effect on the results of straightening and stiffening. The apparatus required for carrying out the method according to the invention is very simple and reliable in operation. When the apparatus according to the invention is incorporated in the automatic machine for manufacturing starting sheets, the straightening device for semi-finished cathodes required in the process according to U.S. Pat. No. 3,544,431 and extra personnel are not necessary. Consequently, the costs are considerably lower and the total process from starting sheets to cathodes is faster.

DESCRIPTION OF THE PREFERRED EMBODIMENT

Figure 1:
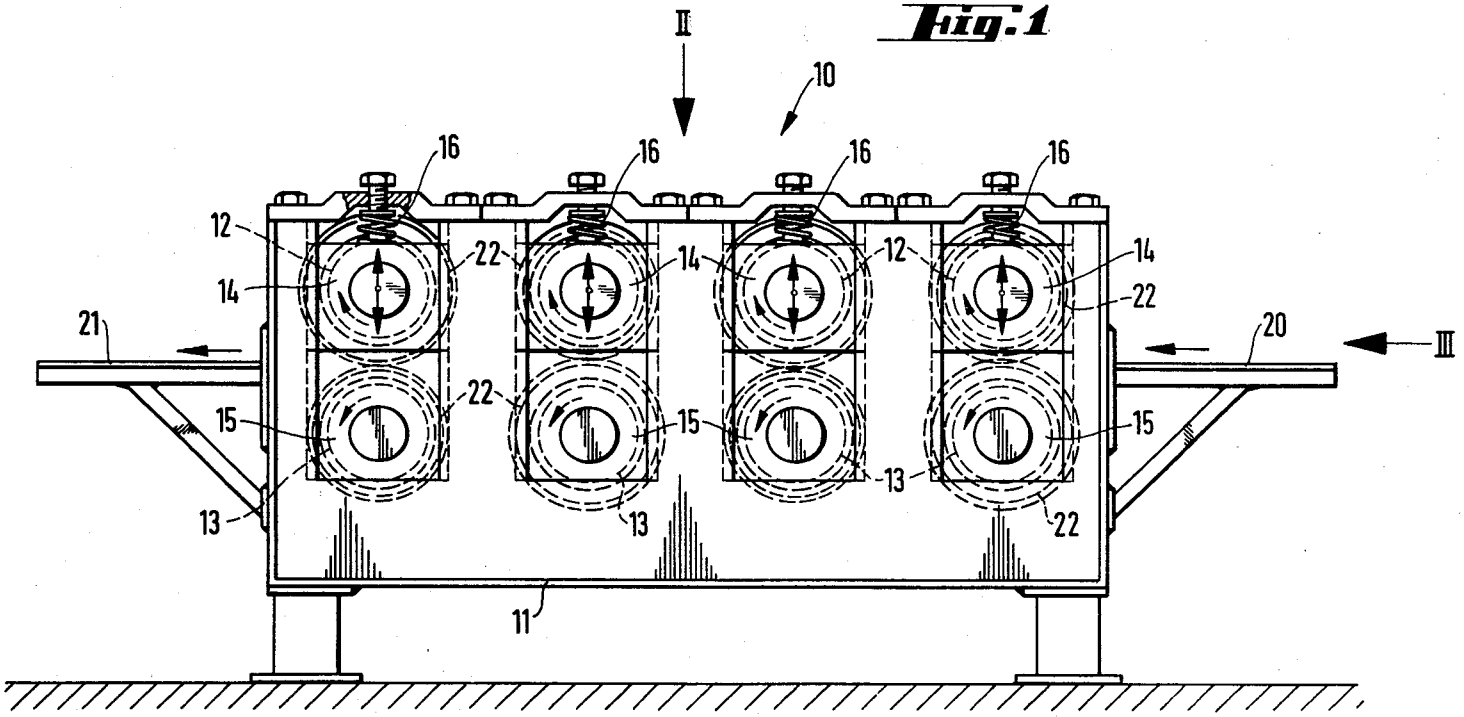
FIG. 1 depicts a side elevation of a device used for carrying out the method according to the invention.
Figure 2:
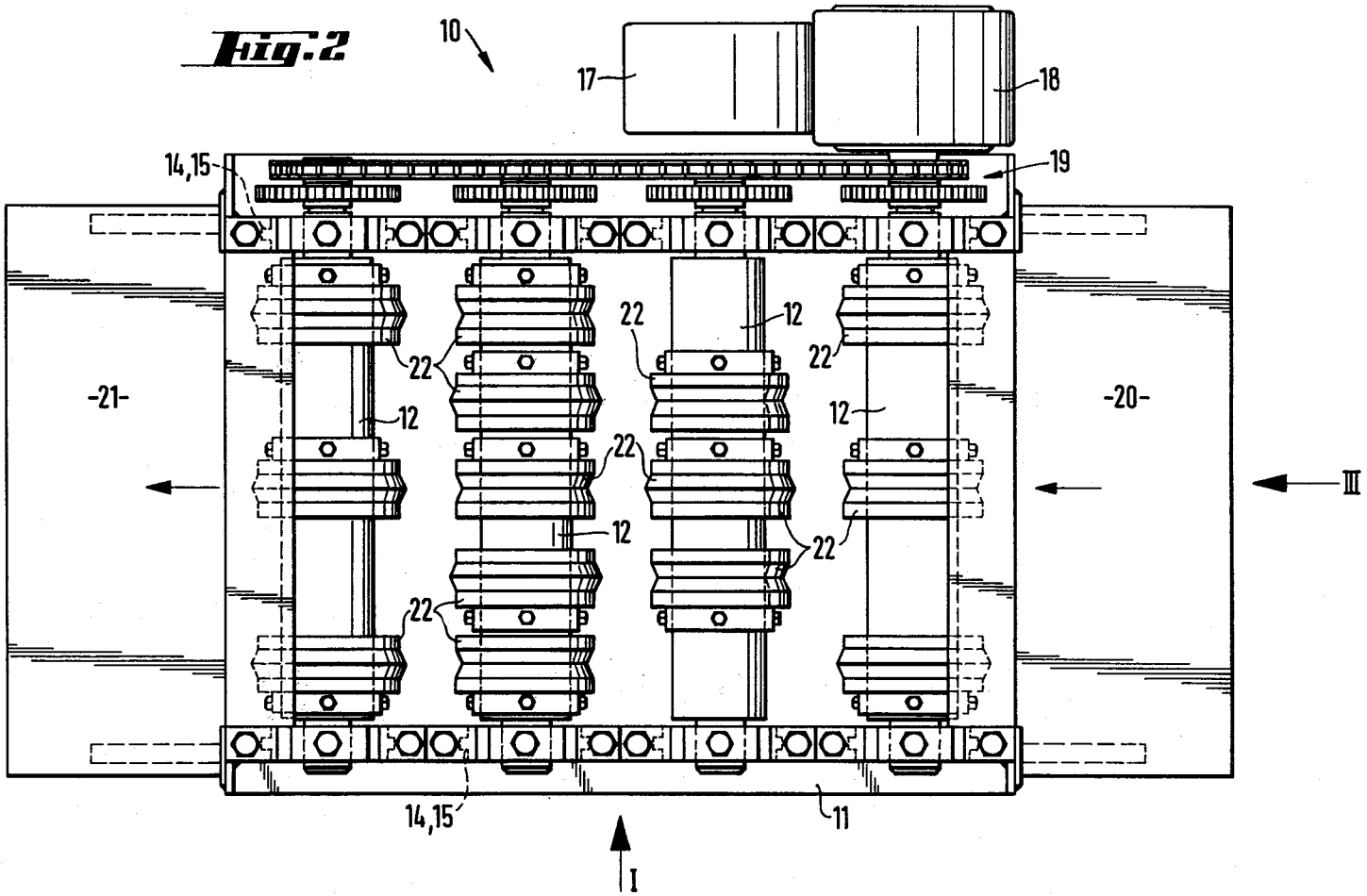
FIG. 2 depicts a plan view of the apparatus according to FIG. 1.
Figure 3:
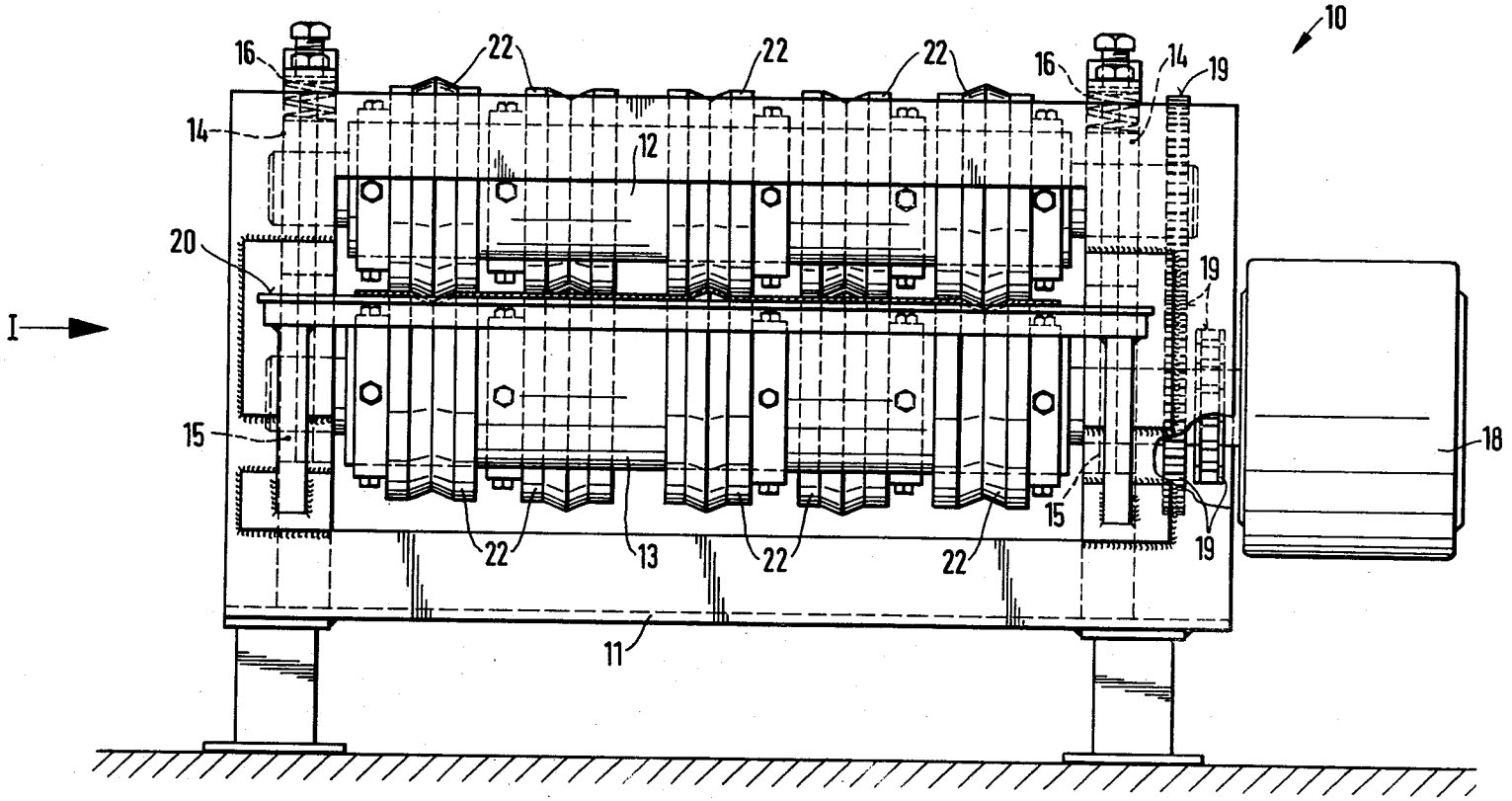
FIG. 3 depicts a front view of the apparatus according to FIG. 1.

In the embodiment according to FIGS. 1-3, the apparatus intended for carrying out the method according to the invention is indicated overall by reference numeral 10. The apparatus 10 includes a frame part 11. Rollers 12 and respectively 13 are attached at their both ends to the frame part 11 by mediation of separate bearing components 14 and respectively 15. The rollers 12 and 13 have been grouped into roller pairs, each consisting of two rollers 12 and 13, one on top of the other. The bearing components 14 of one roller, in this embodiment the upper roller 12, of each roller pair 12, 13 can move independently of each other in the vertical direction, supported by, for example, guides. The movable roller 12 of each roller pair is pressed by means of springs 16 at its bearing components 14 towards the other roller 13 of the roller pair, the pressing force of the springs 16 being controllable. The desired minimum distance between the rollers 12 and 13 is delimited by means of fixed stops (not shown). The roller pairs 12, 13 are situated in parallel at certain intervals from each other and in such a manner that the gaps produced by means of stops between the rollers 12 and 13 of the roller pairs 12, 13 are at the same level.

Figure 4:
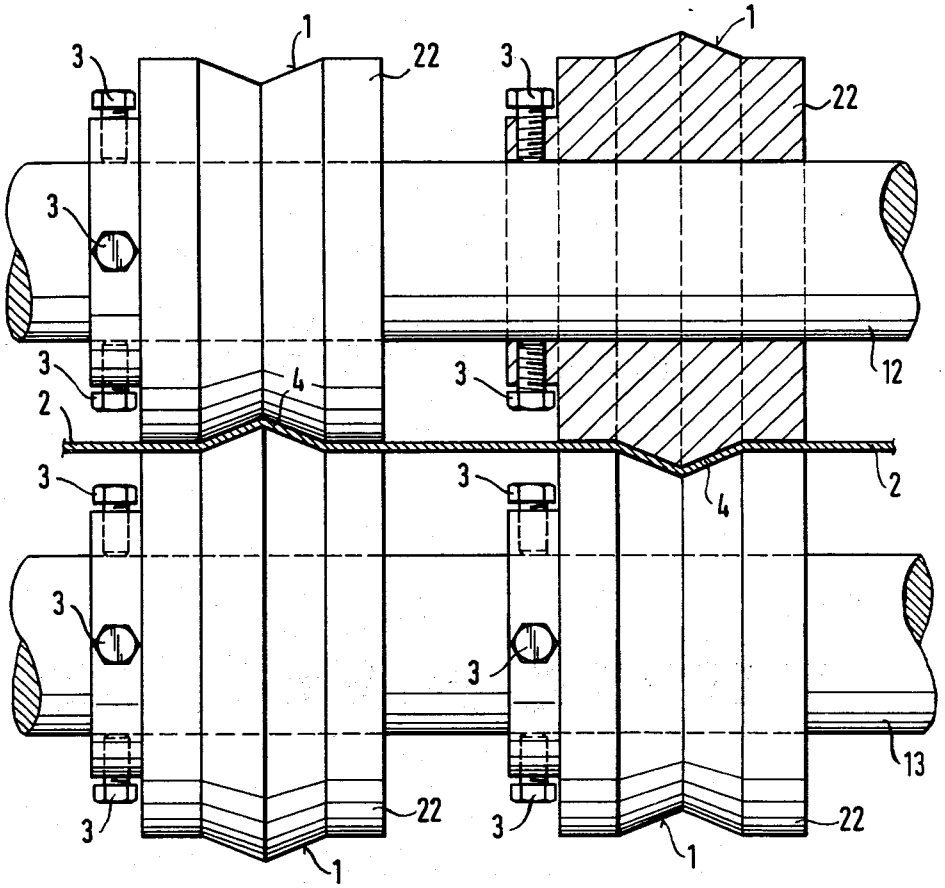
FIG. 4 is an enlargement of a detail in FIG. 3, i.e. a front view of part of the apparatus.

The necessary rotational motion of the rollers 12 and 13 is produced by means of an electric or hydraulic motor 17, and the rotational velocity of the rollers 12 and 13 is adjusted by means of gears 18, from which the rotational motion is transmitted to each roller 12, 13 by means of an encased chain mechanism or gear mechanism, or a combination of these, 19. The apparatus 10 according to the invention also includes a starting sheet feed table 20 and respectively a starting sheet unloading table 21, which are at the same level. FIG. 4 shows sleeves 22 attached by means of fastening nuts 3. The sleeves 22 have profiles as indicated by reference numeral 1 for forming grooves 4 in the starting sheet 2.

According to the basic concept of the invention, the desired profile or pattern has been made in the surface of each roller 12 and 13, or each roller 12 and 13 has a detachable mantle or sleeves 22, the surfaces of which have the desired profile or pattern to be shaped in the starting sheets. In the embodiment according to FIGS. 1-3, sleeves 22 have been placed on the rollers 12 and respectively 13, the sleeves 22 being attached in place by means of retainer screws or other attachment members in such a manner that the sleeves 22 can be moved on the rollers 12 and respectively 13. When desired, certain sleeves 22 can be removed from the rollers 12 and respectively 13, or respectively more sleeves 22 can be installed on the rollers 12 and 13, whereby the place, number and shape of the grooves or folds, or patterns formed by the same, and the number of the back-and-forth shapings, can be varied conveniently.

The operation of the apparatus 10 according to the invention is as follows: A starting sheet detached from the base plate is brought to the feed table 20 manually or by means of devices which are part of the starting manufacturing machine, the starting sheets are transferred to inside the apparatus 10 and the edge of the starting sheet is forced between the rollers 12 and 13 of the first roller pair, 12, 13, rotating in opposite directions. The sleeves 22 on the rollers 12 and respectively 13 shape in the starting sheet grooves or groove patterns, depending on the sleeves, and at the same time convey the starting sheet onwards towards the next roller pair 12, 13.

The rollers 12 and 13 have so large a diameter that the roller pair 12, 13 towards which the starting sheets are being conveyed forces, owing to its shape and its rotation, the edge of the starting sheet to be guided between the rollers 12 and 13 without any separate guide members. Furthermore, the distances between the roller pairs 12, 13 are such that, with the exception of the entering and exit of the starting sheet, at least two roller pairs 12, 13 shape the starting sheets simultaneously.

Variations in the thickness of a starting sheet force one roller 12 of each roller pair 12, 13 to move in the vertical direction. By adjusting the springs 16 linked to the bearing components 14 of the rollers 12, the forces which press the starting sheet in each roller pair 12, 13 can be affected.

Shaping sleeves 22 are advantageously located on roller pairs 12, 13 in such a manner that the groove or fold, or pattern consisting of these, which has been produced by means of sleeves 22 in the roller pair 12, 13 shaping a certain area of the starting sheet surface is produced on the opposite side of the starting sheet in the subsequent roller pair 12, 13, the sleeves 22 on this latter roller pair being installed in the apparatus 10 in alignment with the said previous sleeves 22.

In the apparatus 10 according to the invention, each roller pair 12, 13 conveys the starting sheet onwards while shaping it, and the last roller pair 12, 13 pushes the starting sheet onto the unloading table 21, from which it is conveyed onwards either manually or by means of a device which is part of the starting sheet manufacturing machine.

Only the principle of the method according to the invention and one preferred embodiment of the apparatus intended for carrying out the method according to the invention have been described above. For an expert in the art it is evident that the invention can be modified in several different ways within the inventional idea disclosed in the accompanying patent claims.

What is claimed is:

1. A method for the straightening and stiffening of starting sheets in electrolytic refining plants, comprising shaping the same predetermined areas of the starting sheet surfaces at least once during successive shaping stages in such a manner that the elasticity range of the starting sheet material is at least in part exceeded, comprising pressing certain areas of the sheet in one shaping stage into patterns deviating from the plane of the starting sheet surface, then pressing the same areas in the opposite direction in a second shaping stage to work harden the sheet material, the pressing force of a movable roller of each of a plurality of roller pairs against the other roller of each roller pair being adjusted in order to produce a pressing force of desired degree.

2. An apparatus for straightening and stiffening starting sheets in electrolytic refining plants, comprising:

(a) a frame;

(b) at least two roller pairs with two superimposed rollers, the roller pairs being situated at a distance from each other and mounted to the frame, the surface of the said rollers being provided with a pattern to be shaped in the starting sheets for pressing certain areas of a sheet first in one direction and then in the opposite direction to work harden the sheet material;

(c) separate bearing means for mounting the rollers to the frame; and (d) means for rotating the rollers.

3. The apparatus of claim 2, in which the rollers are provided with a mantle or sleeves the surface of which has the desired pattern.

4. The apparatus of claim 3, in which sleeves are mounted on the rollers by means of attachment members in such a manner that the sleeves are movable on the rollers.

5. The apparatus of claim 2, 3, or 4, in which the bearing means of one roller of each roller pair have been fitted to move, independently of each other, to a limited extent in the vertical direction.

6. The apparatus of claim 5, further comprising spring means for pressing the movable roller of each roller pair towards the other roller of the roller pair.

7. The apparatus of claim 6, in which the pressing force of the said spring devices is adjustable.

8. The apparatus of claim 2, 3, or 4, in which the means for rotating the rollers is an electric or hydraulic motor.

9. The apparatus of claim 2, 3, or 4, further comprising gears for changing the rotational velocity of the rollers.

10. The apparatus of claim 2, 3, or 4, further comprising an encased chain or gear mechanism, or a combination of these two, in order to transmit rotational motion to each roller.

11. The apparatus of claim 2, 3, or 4, further comprising a starting sheet feed table and a starting sheet unloading table positioned at substantially the same level.

* * * * *

UNITED STATES PATENT AND TRADEMARK OFFICE

CERTIFICATE OF CORRECTION

PATENT NO. : 4,411,146

DATED : October 25, 1983

INVENTOR(S) : Jukka Sulasaari et al

It is certified that error appears in the above—identified patent and that said Letters Patent is hereby corrected as shown below:

Title Page, under "ABSTRACT", second paragraph, lines 25-33 omitted. Should read as follows:

--The apparatus being used for straightening and stiffening starting sheets in electrolytic refining plants, comprises a frame; at least two roller pairs consisting of two superimposed rollers, the roller pairs being situated at a distance from each other and being attached by means of bearings to the frame of the apparatus, the surface of the said rollers being provided with the desired profile or patterns which is shaped in the starting sheets; and drive means for producing the rotational motion of the rollers.--

Signed and Sealed this

*Twenty-eighth* Day of *February 1984*

[SEAL]

*Attest:*

GERALD J. MOSSINGHOFF

*Attesting Officer*

*Commissioner of Patents and Trademarks*